US007073610B2

(12) United States Patent
Susman

(10) Patent No.: US 7,073,610 B2
(45) Date of Patent: Jul. 11, 2006

(54) DOWNHOLE TOOL

(75) Inventor: Hector Fillipus Alexander Van Drentham Susman, Aberdeen (GB)

(73) Assignee: Rotech Holdings Limited, Aberdeen (GB)

( * ) Notice: Subject to any disclaimer, the term of this patent is extended or adjusted under 35 U.S.C. 154(b) by 0 days.

(21) Appl. No.: 10/716,898

(22) Filed: Nov. 18, 2003

(65) Prior Publication Data

US 2004/0140131 A1 Jul. 22, 2004

Related U.S. Application Data

(63) Continuation of application No. PCT/GB02/02381, filed on May 20, 2002.

(30) Foreign Application Priority Data

May 19, 2001 (GB) ..... 0112261.3

(51) Int. Cl.
*E21B 4/14* (2006.01)

(52) U.S. Cl. ..... 175/51; 175/297; 173/53

(58) Field of Classification Search ..... 173/53–55; 175/51, 135, 293–300
See application file for complete search history.

(56) References Cited

U.S. PATENT DOCUMENTS

| | | | | |
|---|---|---|---|---|
| 2,214,970 A | | 9/1940 | Mooney | 255/61 |
| 2,756,723 A | | 7/1956 | Bassinger | 121/30 |
| 3,361,220 A | | 1/1968 | Brown | 175/237 |
| 3,946,819 A | | 3/1976 | Hipp | 175/296 |
| 4,284,153 A | * | 8/1981 | Reaugh | 175/297 |
| 4,319,646 A | | 3/1982 | Emonet | 173/111 |
| 4,462,471 A | | 7/1984 | Hipp | 175/296 |
| 4,705,118 A | | 11/1987 | Ennis | 175/65 |
| 4,865,125 A | * | 9/1989 | De Cuir | 166/178 |
| 5,033,557 A | * | 7/1991 | Askew | 175/297 |
| 5,156,223 A | | 10/1992 | Hipp | 175/296 |
| 6,062,324 A | | 5/2000 | Hipp | 175/296 |

FOREIGN PATENT DOCUMENTS

| | | |
|---|---|---|
| WO | WO 97/46791 | 11/1997 |

* cited by examiner

*Primary Examiner*—Frank S. Tsay
(74) *Attorney, Agent, or Firm*—Winston & Strawn LLP

(57) ABSTRACT

A downhole tool for generating a longitudinal mechanical load. In one embodiment, a downhole hammer is disclosed which is activated by applying a load on the hammer and supplying pressurizing fluid to the hammer. The hammer includes a shuttle valve and piston that are moveable between first and further position, seal faces of the shuttle valve and piston being released when the valve and the piston are in their respective further positions, to allow fluid flow through the tool. When the seal is releasing, the piston impacts a remainder of the tool to generate mechanical load. The mechanical load is cyclical by repeated movements of the shuttle valve and piston.

62 Claims, 8 Drawing Sheets

DOWNHOLE TOOL

CROSS-REFERENCE TO RELATED APPLICATIONS

This application is a continuation of International application PCT/GB02/02381 filed May 20, 2002, the entire content of which is expressly incorporated herein by reference thereto.

BACKGROUND ART

The present invention relates to a downhole tool. In particular, but not exclusively, the present invention relates to a downhole tool for generating a longitudinal mechanical load.

A variety of different downhole tools are used in the oil and gas exploration and production industry. Existing downhole tools used for generating longitudinally directed mechanical loads, such as impact hammers, are designed primarily for the installation and/or retrieval of downhole assemblies, for example, nipples. Such existing hammers tend to be either structurally very simple or very complicated, with a large number of co-operating moving parts.

An example of a hammer of the structurally simple type is the "Plotsky" type hammer, which makes use of fluid swirls to develop a hammer action. In the Plotsky hammer, a fluid swirl is generated downstream of a nozzle in a fluid flow path. When the swirl breaks up, the fluid velocity decreases, causing an increase in the fluid pressure, which moves a piston in a percussive hammer action as the swirl builds up and breaks repeatedly. However, this results in poor performance of the hammer and, the fluid swirl is difficult to control.

Disadvantages associated with structurally complex hammers include that the hammers are difficult and expensive to manufacture, assemble and maintain.

Further types of downhole tools used for generating a longitudinally directed mechanical load include "fishing tools". Fishing tools are used to recover downhole tools or strings of tubing which have become inadvertently stuck in a borehole and which cannot be removed by conventional means. Fishing tools are designed to latch onto the stuck tool or string and the fishing tool is then pulled from surface to dislodge the stuck tool or string and carry it to surface. In extreme circumstances where a fishing procedure fails, it is necessary to drill or mill the tool or string out of the borehole to re-open the hole.

The prior art devices exhibit various disadvantages, and the present invention now obviates or mitigates at least one of those disadvantages.

SUMMARY OF THE INVENTION

According to a first aspect of the present invention, there is provided a downhole tool for generating a mechanical load, the tool comprising:

first and second members each moveable between at least a respective first and a respective further position in response to an applied fluid pressure; and a sealing assembly for preventing fluid flow through the tool, the sealing assembly being released when the first and second members are in their respective further positions, to allow fluid flow through the tool;

whereby, in use, when the sealing assembly is released the second member impacts a remainder of the tool to generate a mechanical load.

This provides a downhole tool which may be used to generate a reciprocating mechanical load having many uses in the downhole environment, for example, as part of a drilling assembly to improve the rate and efficiency of drilling; to set tools or tool strings in a downhole environment by hammering the tool into place; to dislodge tools or tool strings which have become lodged downhole by exerting a hammer force on the tool; and for recovering or "fishing" tools which have become lodged downhole.

The downhole tool may comprise a downhole hammer for generating a mechanical impact load. The impact load may be directed towards a lower end of a borehole in which the downhole tool is located. Alternatively, the axial load may be directed towards an upper end of the borehole. The downhole tool may therefore comprise a hammer forming part of a fishing string or retrieval string for retrieving a tool, tool string, downhole tubing or any other object from a borehole.

Preferably, the downhole tool is activatable in response to a combination of a primary mechanical load applied to the tool and fluid pressure. Thus, in order to activate the tool, it is necessary to apply a primary mechanical force and to apply fluid pressure. For example, it may be necessary to set weight down onto the tool and to apply fluid pressure to activate the hammer. Alternatively, it may be necessary to apply a primary upwardly directed load on the tool and to apply fluid pressure. This combination of loading and application of fluid pressure activates the tool, to generate the mechanical load.

The further position of the first member may be a second position and the first and second members may be moveable between first and second positions. The second member may be moveable beyond the second position to the further position. Alternatively, the further position of the first and second members may be a second position.

According to a second aspect of the present invention there is provided a downhole hammer comprising:

a first member, a second member and sealing means between said first and second members, wherein, in use, application of fluid pressure to the hammer causes the first and second members to move from respective first to respective second positions and during such movement the sealing means sealing between the first and second members substantially prevents fluid flow therebetween, and wherein further, in use, further application of fluid pressure causes the sealing means to release, to allow the second member to return to the first position whereby the second member is impacted by a remainder of the hammer.

According to a third aspect of the present invention, there is provided a downhole tool for generating a mechanical load, the tool comprising:

a generally hollow housing;

first and second members each disposed at least partly in the housing and movable with respect to the housing between respective first and second positions in response to an applied fluid pressure;

sealing means for sealing between the first and second members during movement of the members from the respective first to the respective second positions; and restraint means for restraining movement of the first member relative to the second member so as to cause the sealing means to release, to allow fluid flow between the first and second members;

whereby such fluid flow allows the second member to return to the first position, to impact the first member and generate the mechanical load.

According to a fourth aspect of the present invention, there is provided a downhole tool for generating a mechanical load, the tool comprising:

a generally hollow housing;

first and second members each disposed at least partly in the housing and moveable with respect to the housing between respective first and second positions in response to an applied fluid pressure; and a sealing assembly adapted to seal the tool to prevent fluid flow through the tool when the first and second members are in their respective first positions and to allow fluid flow through the tool when the first and second members are in their respective second positions;

whereby such fluid flow allows the second member to return to the first position to impact a remainder of the tool and generate the mechanical load.

According to a fifth aspect of the present invention, there is provided a drilling assembly comprising a drilling motor and a downhole hammer or a downhole tool in accordance with any of the first to fourth aspects of the present invention.

According to a sixth aspect of the present invention, there is provided a rotary drill string including a downhole hammer or a downhole tool in accordance with any of the first to fourth aspects of the present invention.

According to a seventh aspect of the present invention, there is provided a downhole hammer assembly including a downhole hammer or a downhole tool in accordance with any of the first to fourth aspects of the present invention.

According to an eighth aspect of the present invention, there is provided an improved method of drilling a borehole comprising the steps of:

coupling a drill bit to a downhole hammer;

rotating the drill bit;

exerting a first force on the drill bit to cause the drill bit to drill a borehole; and activating the downhole hammer to exert a second, cyclical hammer force on the drill bit.

According to a ninth aspect of the present invention, there is provided a method of retrieving an object from a borehole comprising the steps of:

coupling a downhole hammer to the object;

exerting a first force on the downhole hammer and thus on the object; and activating the downhole hammer to exert an additional, cyclical second force on the object.

According to a further aspect of the present invention, there is provided a method of expanding an expandable downhole tubular as described herein.

BRIEF DESCRIPTION OF THE DRAWING FIGURES

Embodiments of the present invention will now be described, by way of example only, with reference to the accompanying drawings, in which.

DETAILED DESCRIPTION OF THE PREFERRED EMBODIMENTS

Figure 2:
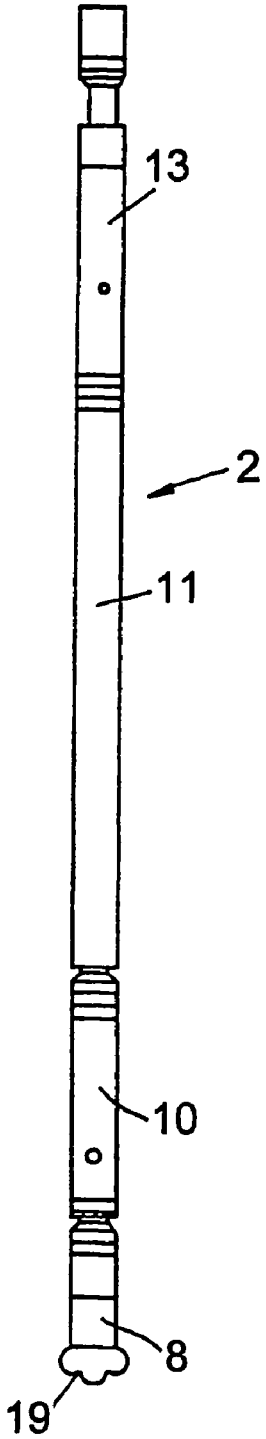
FIG. 2 is an enlarged view of the downhole drilling assembly of FIG. 1.

It will be understood that references herein to longitudinal movement are to movement generally in a direction of a main or longitudinal axis of the downhole tool.

The invention provides a downhole tool which allows for a mechanical load to be generated downhole. It will be understood that references to a mechanical load are to a load generated by the tool which may be transmitted by, for example, a mechanical connection or coupling, to transmit the load to a secondary object or tool located downhole. It will further be understood that the mechanical load is preferably directed longitudinally through the tool and through a borehole in which the tool is located. In particular, the downhole tool comprises an impact hammer for use in downhole operations, which generates a mechanical load in the form of a percussive impact or a percussive pull force in response in part to fluid flowing through the tool.

The downhole tool may be provided as part of a drilling assembly including a drilling motor. Typically, the drilling assembly is run on coiled tubing, however, the assembly may alternatively be run on a drill string comprising sections of connected tubing, or the like. Alternatively, the downhole tool may be provided as part of a rotary drill string rotated from surface. In this fashion, the downhole tool may be utilised to provide a percussive drilling effect or "hammer effect". The combination of impact and rotation of a drill bit coupled to the tool advantageously results in a higher rate of penetration and material removal than would be experienced with either impact or rotation alone.

In a further alternative, the downhole tool may be provided as part of a downhole hammer assembly for hammering assemblies into place downhole and\or to dislodge assemblies to allow retrieval. Typically, the downhole hammer assembly is run at an end of coil tubing or a drill string.

The present invention is particularly advantageous in that the downhole tool, including the first and second longitudinally movable members, is simple to manufacture, assemble and maintain, and functions simply and reliably, without an excessive number of moving parts, to achieve the desired aim of generating a mechanical load. Furthermore, the present invention is advantageous over downhole tools which function with fewer parts, in that it allows the mechanical load to be reliably generated and for the load to be initiated when desired on reaching predetermined threshold values of certain parameters. In particular, such threshold parameters may include the applied fluid pressure and the Weight On Bit (WOB), that is, the force exerted on a drill bit (where the downhole tool is provided as part of a drilling assembly or a rotary drill string) through the drill string or the like.

The second member may be movable to a further, third position, where fluid flow is permitted between the first and second members and through the generally hollow housing. Such fluid may then flow, for example, to a drill bit to remove drill cuttings from a borehole, or may be circulated through a borehole. The first member may be adapted to return to its first position before impacting the second member, such that the weight of at least part of the tool and/or a string carrying the tool and/or WOB is directed through the first and second members.

The tool may further comprise a turning mechanism for rotating at least a part of the tool relative to the remainder of the tool. The turning mechanism may comprise a first mechanism part coupled to the second member of the tool, a second mechanism part for coupling to an object or member to be rotated, and an intermediate mechanism part, coupled to the tool housing and serving for rotating one or both of the first and second mechanism parts.

Preferably, the generally hollow housing defines an internal bore in which the first and second members are disposed for longitudinal movement therein. The housing may be coupled at one end to a first generally tubular member which may take the form of a top sub. The first generally tubular member may define an internal bore, an end of which is adapted to slidably receive at least part of the first member for locating the first member in the housing. The housing, in particular the internal bore of the first generally tubular member, may define or include a flow restriction which may take the form of a nozzle. The flow restriction may be disposed adjacent an end of the first member.

Fluid may be supplied to the downhole tool through a drill string, coil tubing or the like, and the fluid may typically comprise a drilling fluid such as a drilling mud.

The sealing means may comprise respective seal faces of the first and second members, the seal faces being selectively biased into sealing abutment when the first and second members are in the respective first and further second positions and\or moving between the first and second positions, to seal between the first and second members. The first and second members may be biased towards their respective first positions, for example by springs or sprung members.

The sealing assembly may comprise a seal member adapted to prevent fluid flow through the tool when the first and second members are in their respective first positions. The sealing assembly may be adapted to abut the first member to prevent fluid flow and the first member may be movable with respect to the sealing assembly to open fluid flow. The seal member may comprise a valve or collar adapted to receive the first member and the first member may include at least one flow port for fluid flow through the first member; the seal member may close the flow port when the first member is in the first position.

The first member preferably comprises a generally tubular shuttle valve defining an internal bore. One end of the shuttle valve may define a seal face for sealing abutment with the second member. One or more flow ports may be defined through a wall of the first member to selectively allow fluid flow through the first member, and in particular, through the bore and out of the shuttle valve.

The housing may define a chamber or area in fluid communication with the first member through the one or more flow ports, to selectively receive fluid from the first member. Furthermore, the chamber or area may be in selective fluid communication with the second member, to allow fluid flow between the first member and the second member through the chamber or recess. The housing may include one or more ports, such that part of the housing experiences external fluid pressure, in particular the pressure of fluid in a borehole. For example, one end of the second member may experience external fluid pressure, to allow a pressure differential to be generated across the second member. This may allow the second member to move in response to applied fluid pressure.

Alternatively, the second member may include at least one pressure equalisation port for equalising pressure between the outside and the inside of the second member.

The second member may comprise a generally tubular piston defining an internal bore. The bore may be sealed by the sealing means to prevent fluid flow therethrough, when the first and second members are in or moving from their respective first to their respective second positions. The pressure equalisation port may extend through a wall of the piston between a cylinder in which the piston is mounted, the cylinder defined by the housing, and an internal bore of the piston. This may prevent hydraulic lock-up of the piston and allow movement of the piston between the first and further positions. This isolates the piston from borehole pressure, reducing the pressure differential across the piston, thereby reducing the pressure of the fluid required to move the piston between the first and further positions.

The downhole tool may include a coupling for coupling the second member to a secondary member such as, for example, a length of drill tubing, a drill bit, or an assembly to be hammered into place\dislodged. The coupling may comprise a bit box. The coupling may comprise a drive transfer mechanism, which may include a key assembly. The key assembly may comprise a channel or keyway formed on or in the coupling and adapted to receive a key to restrain the secondary member against rotation with respect to the coupling. Preferably, the coupling includes a plurality of keyways, which may be adapted to align with a corresponding plurality of keyways in the secondary member and to receive a respective key in each pair of aligned keyways. The drive mechanism provides a connection which is resistant to torque, to prevent the secondary member from becoming over-torqued during a downhole procedure such as a hammering procedure.

The mechanical load may be generated in the following fashion: the procedure is initiated by setting weight down on the tool through the drill string, coil tubing or the like coupled to the downhole tool. Fluid is then pumped down the tubing through the bore of the top sub and the nozzle and into the internal bore of the shuttle valve, exiting through the flow ports into the chamber defined by the housing. This applies pressure to an upper face of the piston; the front or lower face is exposed to annulus pressure. This pressure differential causes the piston to move longitudinally forwards relative to the housing, in effect, the housing moves back away from the piston. As the piston moves relatively forwards, the shuttle valve is pushed relatively forward, due to the increased pressure behind it. Initially, the shuttle valve is sealed relative to the piston by engagement of the seal faces between the valve and the piston such that fluid does not flow from the shuttle valve to the piston. Both the valve and piston are brought to their respective second positions. The shuttle valve is then restrained from further longitudinal movement with the piston. The piston is then forced relatively longitudinally away from the shuttle valve, such that the seal is released, allowing fluid to flow from the valve to the piston and through the piston bore. This causes the fluid pressure to drop, and the shuttle valve can return to its first position. The piston then rapidly returns to its first position, impacting the shuttle valve and generating the mechanical load. In effect, the housing slams down onto the piston under the applied WOB to impact the shuttle valve against the piston. The fluid pressure once again increases until the piston is again forced away, and repetition of this process imparts the mechanical load or percussive "hammer" action.

Alternatively, the procedure may be initiated by exerting a pull on the tool which has been latched directly or indirectly to the object to be retrieved. Fluid is then pumped down through the tool and acts against the shuttle valve, which is initially in the first position where the flow ports are closed. The fluid pressure also acts on the piston and the piston and shuttle valve move forwards or downwardly, effectively compressing the tool. When the shuttle valve has moved to the second position, the flow ports are opened, allowing fluid flow through the tool. The piston is then returned rapidly to the first position, emptying the piston chamber, the fluid from the chamber exiting through the shuttle valve flow ports and out of the tool. As the piston moves rapidly upwards, it impacts against a shoulder of the tool generating an upward jar which is transmitted to the tool housing and thus to the secondary tool, to release it from the borehole. As the fluid pressure decreases, the shuttle valve also returns to the first position and the procedure is repeating to generate the percussive jarring force.

Conveniently, the restraint means comprises part of the housing, and may comprise a shoulder on an inner wall of the housing adapted to abut and restrain the first member in the second position. It will be understood that the first member is restrained from longitudinal movement beyond the second position in a direction towards the second member, but may move longitudinally away from the second member under forcing action of the biasing spring/WOB when the fluid pressure decreases. The shoulder may comprise a substantially radially inwardly extending shoulder for abutting a co-operating outwardly extending shoulder on the first member.

In an alternative embodiment, the downhole tool may further comprise a key assembly for restraining the second member against rotation with respect to the housing. The key assembly may comprise a key located between an inner surface of the housing and an outer surface of the second member. The key may engage keyways in both the second member and the housing. This may allow the piston to slide longitudinally with respect to the housing without relative rotation.

The downhole hammer or downhole tool assembly may further comprise a shock absorbing tool. The shock absorbing tool may reduce the impact load felt by a string of tubing and other tool assemblies coupled to the downhole tool, to reduce the likelihood of damage. The shock absorbing tool may comprise a body; a shaft moveably mounted to the body, and a biasing or damping assembly coupled between the shaft and the body. In use, the biasing assembly is compressed to exert a damping force on the shaft. The biasing assembly reduces the transmission of impact loading from the shaft to the body and thus to the remainder of the string. The biasing assembly may comprise a biasing spring such as disc or compression springs, or a hydraulic damping assembly.

Figure 1:
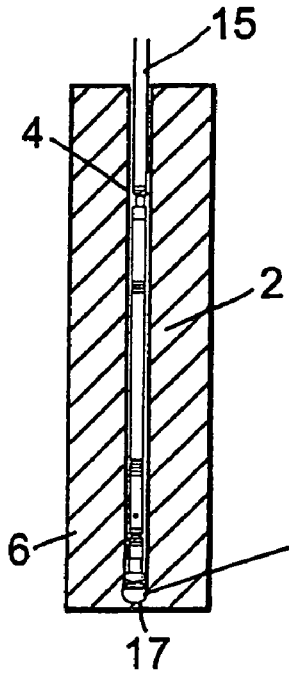
FIG. 1 is a schematic, partial cross-sectional view of a downhole drilling assembly incorporating a downhole tool in accordance with an embodiment of the present invention, shown during drilling of a borehole.

Referring firstly to FIG. 1, there is shown a downhole drilling assembly 2 during the drilling of a borehole 4 in a hydrocarbon bearing formation 6. The drilling assembly 2 is shown in more detail in FIG. 2 and comprises a drill bit 8 coupled to an impact hammer indicated generally by reference numeral 10, with a drilling turbine 11 coupled to the impact hammer 10 and a shock sub 13 coupled to the turbine 11. The shock sub will be described in more detail below with reference to FIG. 6. The drilling assembly is run on a string of drill tubing 15, which typically comprises sections of threaded drill tubing coupled together to form the string.

The impact hammer provides a percussive drilling effect or "hammer effect", to assist in formation of the borehole 4. Specifically, the hammer 10 improves the rate of progress of the drill bit 8 by hammering the bit 8 during the drilling procedure. This hammer action assists in breaking up the formation 6, but also acts to disturb drill cuttings formed during the drilling procedure.

Figure 3:
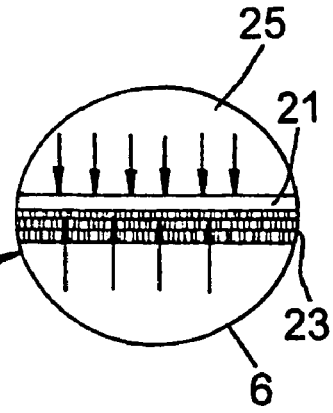
FIG. 3 is an enlarged view of a lower end of the borehole of FIG. 1.

In particular, FIG. 3, which is an enlarged, schematic view of the lower end 17 of the borehole 4, illustrates the situation where the borehole 4 is drilled in deep and high-pressure formations. In this situation, drilling mud, which is used as part of the cutting procedure to carry drill cuttings to surface, may have a "mud weight" (the mud pressure at depth) greater than the pore pressure of the formation 6. This differential between the mud pressure and the formation pressure can cause drill cuttings to stick to the cutting face 19 of the drill bit 8, forming a "filter cake" 21 between the crushed formation 23 and the drill bit 8. This sticking of the drill cuttings makes drilling very slow and degrades the drill bit cutting ability as the trapped cuttings act as grinding paste on the surface of the drill bit 8. Using the downhole hammer 10 in conjunction with the drilling motor 11 improves the rate of progress whilst drilling, as the hammer action at the drill bit face 19 squeezes out drill cuttings to allow cutters in the drill bit 8 to perform their cutting action in the surrounding rock formation 6. Whilst the impact hammer 10 has a particular use as part of the drilling assembly 2, the hammer has further uses on its own as a device to hammer assemblies into place downhole or to dislodge them to allow retrieval. Such assemblies may include strings of tubing, tools or tool strings including packers, valves and the like, or indeed any of the tools typically found in the downhole environment. In this case, the impact hammer 10 is typically run on the end of a coil tubing rig or a drill string.

The impact hammer 10 is shown in more detail in the enlarged sectional view of FIGS. 4A to 4D, and comprises a generally hollow housing 12; first and second members, in the form of a shuttle valve 14 and a piston 16, respectively, disposed in the housing 12 and movable longitudinally with respect to the housing; a sealing assembly for sealing the shuttle valve 14 to the piston 16, in the form of seal faces 18 and 20 of the valve 14 and the piston 16, respectively; and a restraint in the form of a stop shoulder 22 for restraining the shuttle valve 14.

As will be described in more detail below, the shuttle valve 14 and piston 16 are movable longitudinally within the housing 12 between respective first and further positions; in FIG. 4A, the valve 14 and piston 16 are shown in their first positions. In their first positions, and indeed, during movement between the first and second positions (FIG. 4B), the shuttle valve 14 and the piston 16 are in abutment, where the seal faces 18 and 20 seal the valve 14 to the piston 16, such that fluid flow therebetween is prevented. The shuttle valve 14 and piston 16 are moved between their first and second positions in response to an applied fluid pressure, and when the valve 14 and piston 16 are in their second positions (FIG. 4B), fluid pressure moves the piston 16 away from the valve 14 (FIG. 4C) causing the seal between the seal faces 18 and 20 to release. This allows fluid to flow between the valve 14 and the piston 16, reducing the fluid pressure, such that the valve 14 returns to its first position (FIG. 4D). The piston 16 is then also returned rapidly to its first position, impacting with the first member (FIG. 4A) to generate the mechanical load. This cycle is then repeated to generate a cyclical or "percussive" impact through the hammer 10, which is imparted on the drill bit 8.

In more detail, and describing the impact hammer 10 top-to-bottom, the hammer 10 includes a top sub 24 having a tapered screw connection 26 for coupling the hammer 10 to the drill string 15. The top sub 24 defines an internal through-bore 28 for the passage of drilling mud into the hammer. A flow restriction in the form of a nozzle 30 is provided in the bore 28 and acts as a restriction to flow of fluid through the bore. A lower part 32 of the bore 28 receives the shuttle valve 14 in a sliding engagement, as will be described below. The top sub 24 is coupled to the hollow hammer housing 12 by a cylindrical threaded connection 34, and defines an upper end of the impact hammer 10.

The shuttle valve 14 includes a shuttle 36 which is generally tubular, defining an internal bore 38. An upper end 40 of the shuttle 36 is mounted in the lower part 32 of the bore 28. A locating ring 42 is provided within the housing 12 and defines the stop shoulder 22, which both acts as a restraint for the shuttle valve 14 and as a guide for the valve 14 during its sliding longitudinal movement.

A lower end of the shuttle 36 defines the seal face 18, and an angled port 44 allows for fluid flow through the bore 38 and out of the shuttle 36. A biasing spring 46 is mounted between the locating ring 42 and a shoulder 48 on the shuttle 36, and biases the shuttle 36 towards the top sub 24. For a 3c" impact hammer, the spring 36 is typically of a free length of 3", a compressed length of 1.6" and of an outside diameter of 2.080". The spring force is 100 lbs, the wire diameter 0.175", with four coils and a spring rate of 70 lbs/in.

The shuttle valve 14 is located with the main part of the shuttle 36 in a chamber 50 defined by the housing 12, with an area 52 adjacent to the port 44. The area 52 is defined by a radially extending shoulder 54 of the housing 12 and allows pressure equalisation between the chamber 50 and a further chamber 58 defined by the housing 12.

The piston 16 is generally tubular, defining an internal through-bore 60 for the passage of fluid. Sliding seals 62 are provided at an end of the piston 16 adjacent the shuttle valve 14, for sealing the piston 16 in the housing 12. A biasing spring 64 is mounted on the piston 16 and biases the piston towards the shuttle valve 14. The spring 64 has a free length of 3.5", a compressed length of 2.5" and is of an outside diameter of 2.609". The spring force is 340 lbs, the wire diameter is 0.280", with five coils and a spring rate of 214 lbs/in. The spring 64 and weight on bit (WOB) applied through the string 15 onto the drill bit 8 brings the seal faces 18 and 20 into abutment, in the absence of applied fluid pressure. Pressure equalisation ports 70 extend through the wall of the housing 12 to equalise pressure between an annular chamber 72 in which the spring 64 is located, and the borehole, to allow movement of the piston 16. The ports 70 and area 52 thus prevent hydraulic lock-up of the shuttle valve 14 and piston 16 in use, during movement between their first and further positions.

A piston mounting assembly 66 is provided at the bottom of the housing 12 for mounting the piston 16 in the housing and for supporting the piston during its movement between the first and second positions. The mounting assembly 66 includes a collar 74 which is secured inside the housing 12 and sealed to the piston 16. A lower end 76 of the piston 16 is coupled to part of a turning mechanism 78 which rotates part of the tool 10 in use, as will now be described.

Figure 4A:
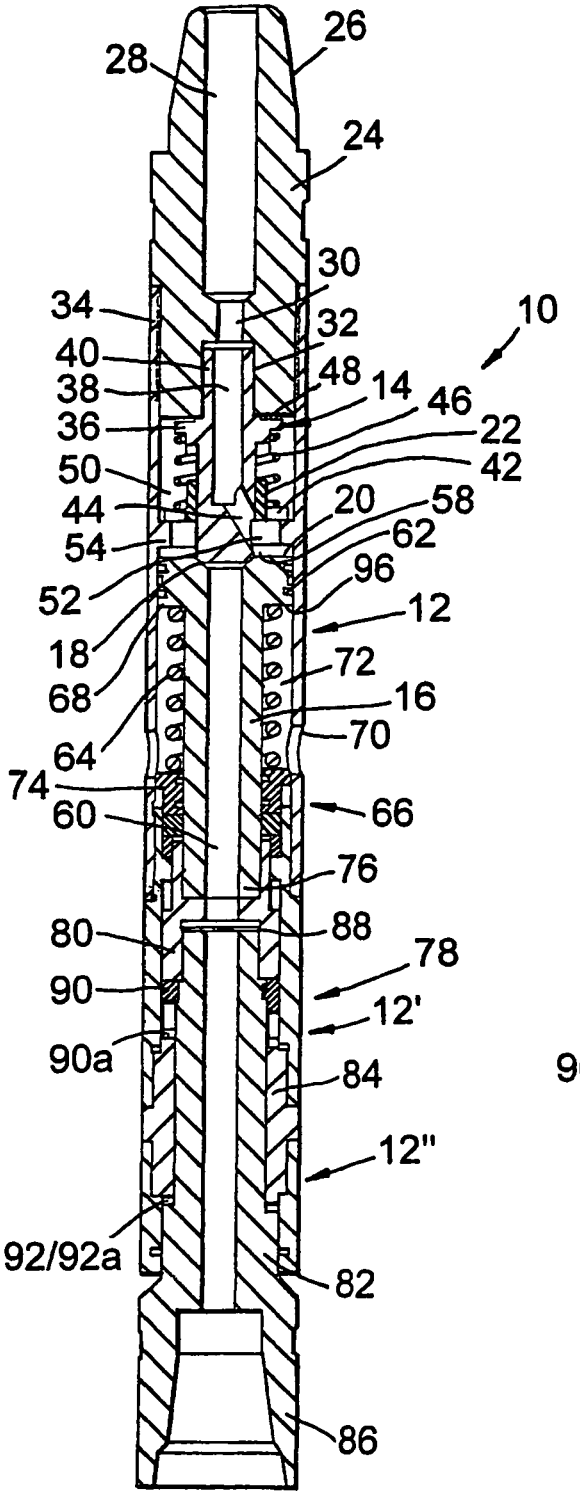
FIGS. 4A to 4D are longitudinal cross-sectional views of the downhole tool of FIGS. 1 and 2 shown at various stages of a cycle in which the tool generates a mechanical load.
Figure 4B:
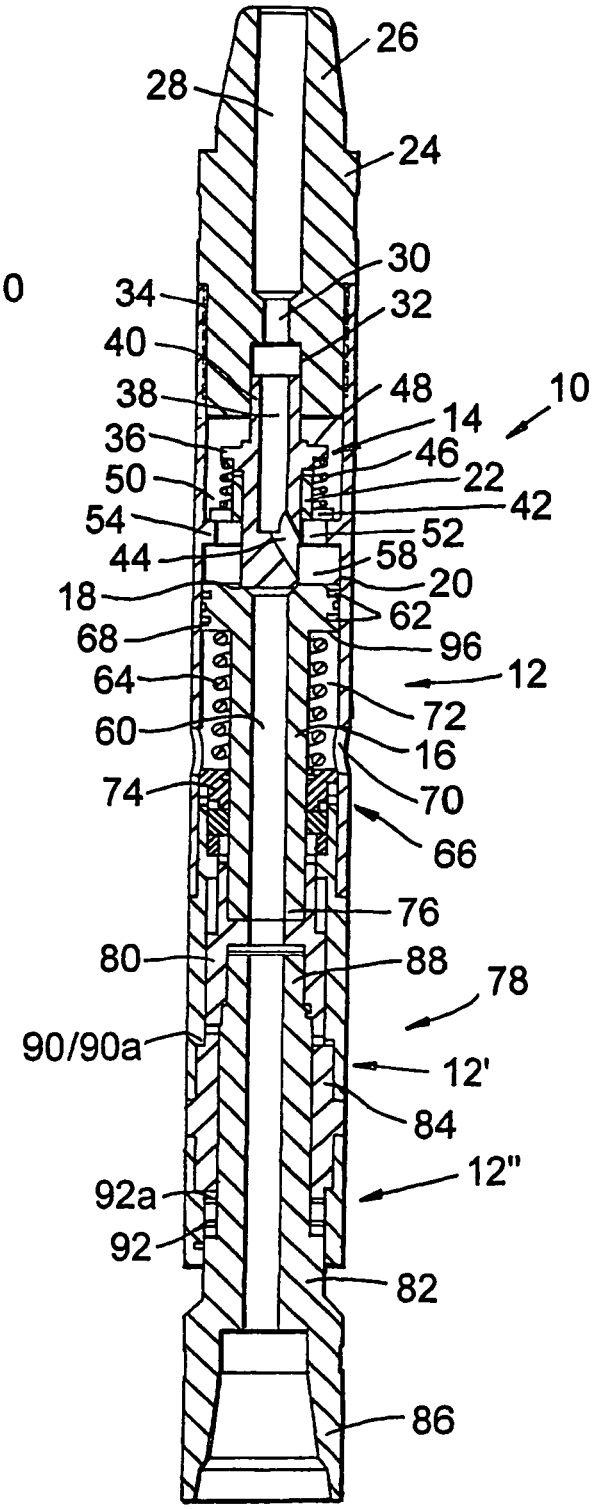
Figure 4C:
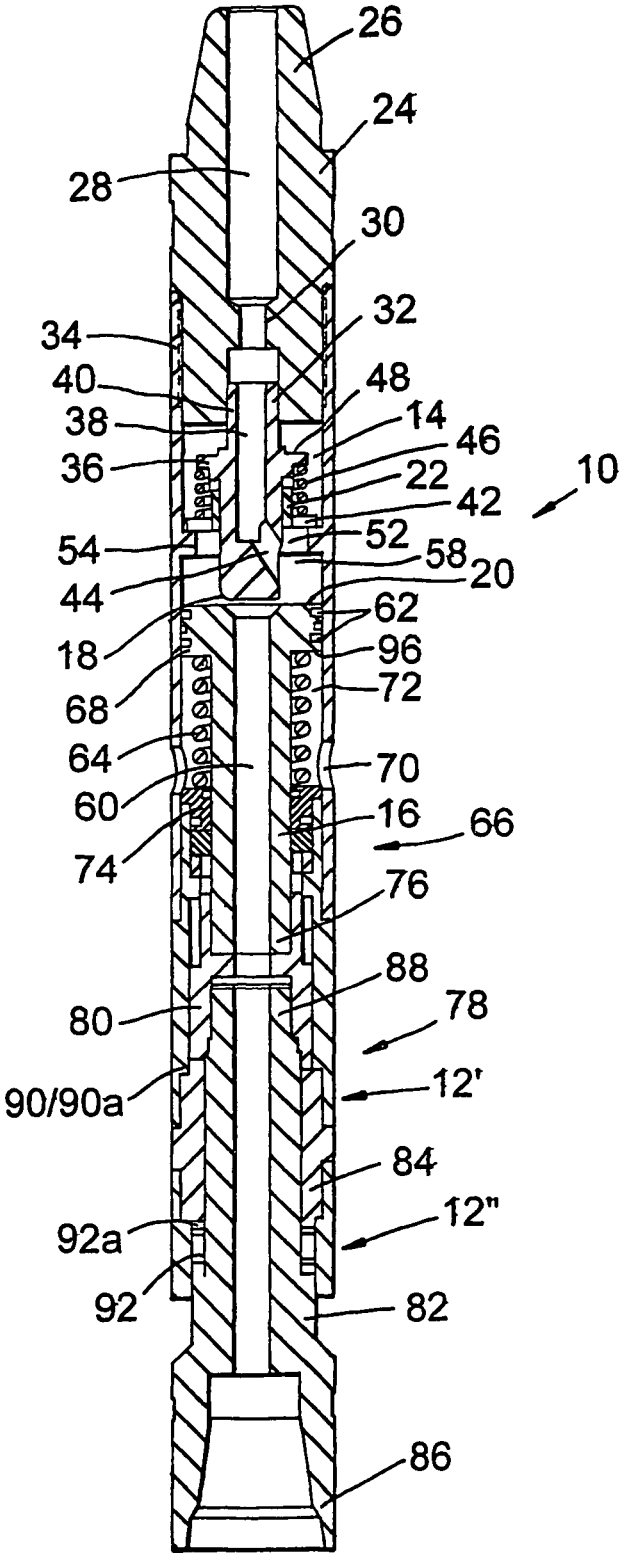
Figure 4D:
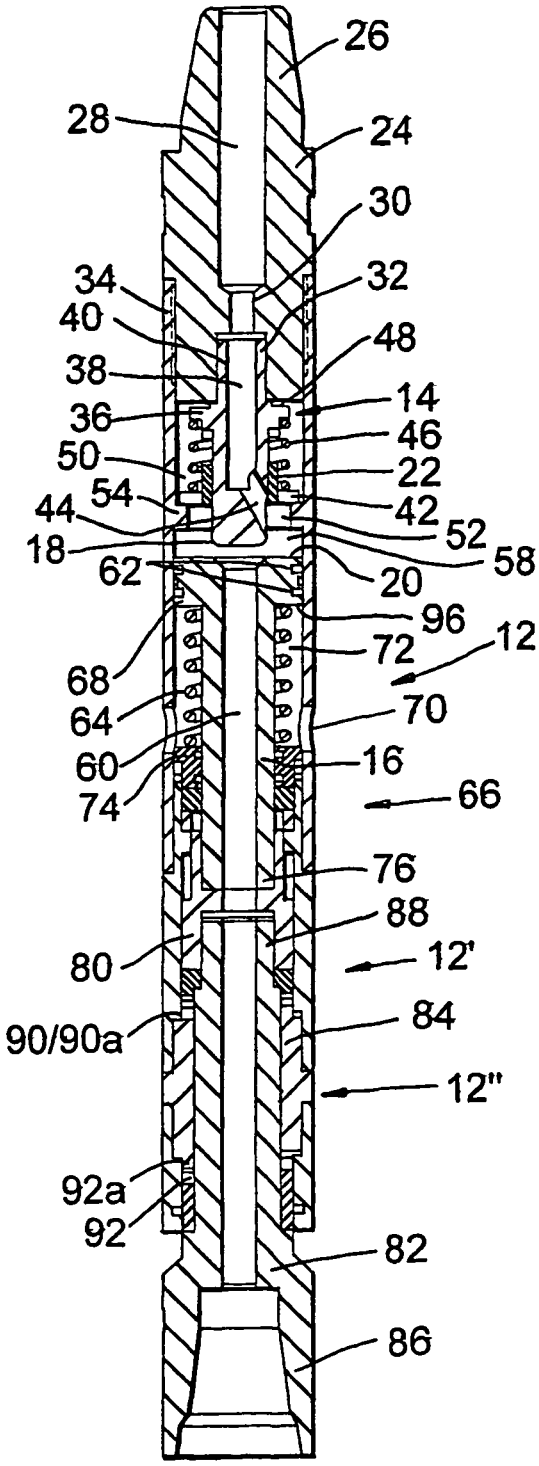
Figure 5A:
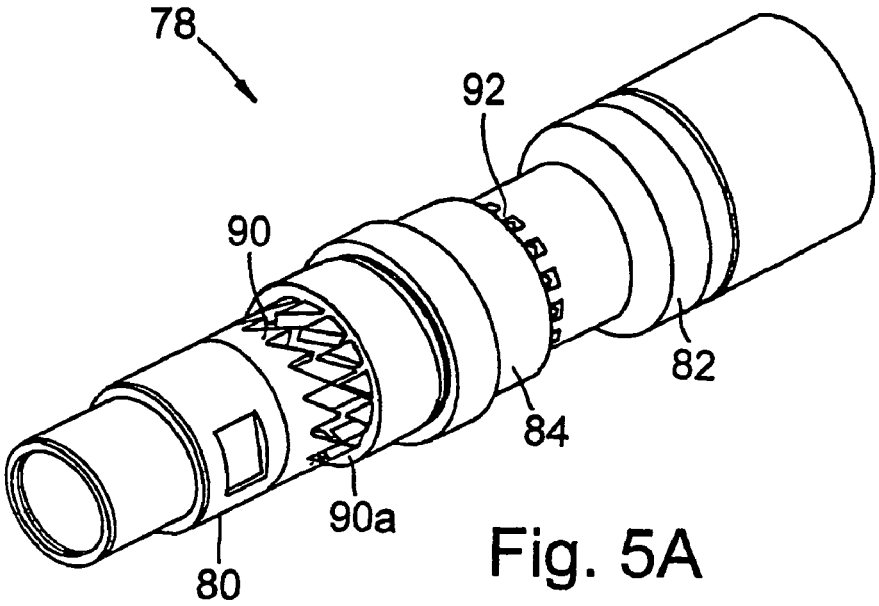
FIGS. 5A and 5B are perspective views of one embodiment of a turning mechanism forming part of the tool of FIGS. 4A to 4D.
Figure 5B:
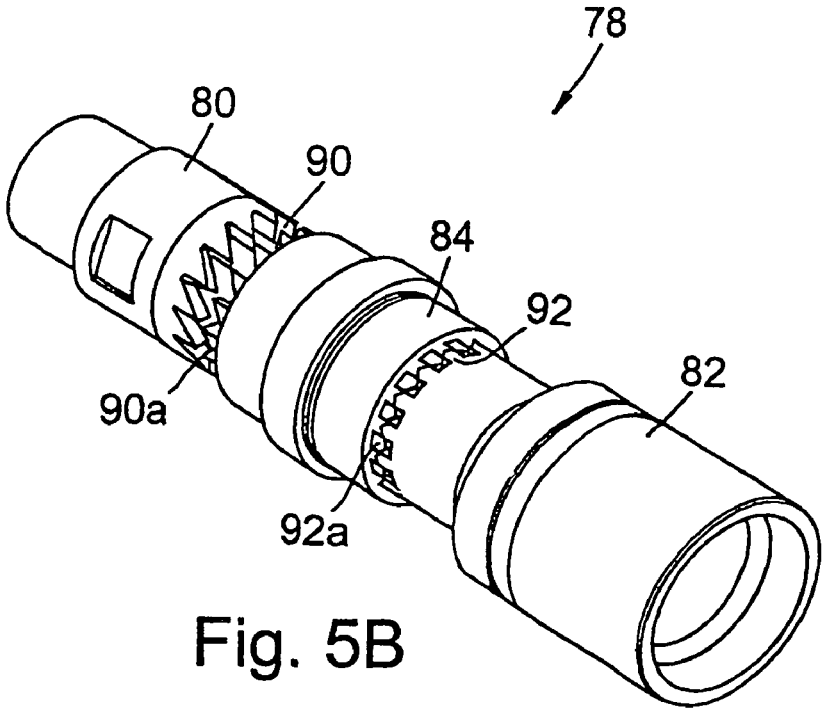

The turning mechanism 78 is shown in more detail in the perspective views of FIGS. 5A and 5B, and generally includes a first mechanism part in the form of tube 80, a second mechanism part in the form of a coupling tube 82 and an intermediate mechanism part in the form of sub 84. As shown in the cross-sectional view of FIGS. 4A–4D, the coupling tube 82 carries a bit box for coupling the tool 10 to a length of drill string, drill bit or the like. The coupling tube 82 is slidably mounted in the sub 84 and is threaded to the tube 80 at an upper end 88, and the tube 80 is itself threaded to the lower end 76 of the piston 16. Thus, it will be understood that during the above described movement of the piston 16, the tube 80 and coupling tube 82 are moved together with the piston 16.

The turning mechanism 78 is mounted in an extension 12' of the tool housing and the sub 84 is in turn mounted to the lower end of the housing extension 12', with a further extension 12" mounted to the lower part of the sub 84 and sealed to the coupling tube 82, to prevent fluid ingress into the tool 10.

As shown particularly in FIGS. 5A and 5B, the tube 80 carries a set of angled teeth 90 and the coupling tube 82 carries a set of castellated teeth 92. The sub 84 carries corresponding sets of angled teeth 90*a* and castellated teeth 92*a* which are selectively meshed with the teeth 90 on tube 80 and the teeth 92 on coupling tube 82, when the piston 16 is moved within the tool 10 as described above.

Only one set of the teeth 90/90*a* or 92/92*a* are meshed at any one time. Furthermore, the sets of teeth 90/90*a* and 92/92*a* are offset with respect to one another such that selective meshing of one of the sets 90/90*a* or 92/92*a* causes a corresponding rotation of the tube 80 and the coupling tube 82. In particular, the castellated teeth 92/92*a* are profiled and arranged on the turning mechanism 78 so as to provide an 18° rotation of the tube 80 and the coupling tube 82, when meshed. On the other end, the angled teeth 90/90*a* are profiled and arranged on the mechanism 78 to provide a 6° rotation when meshed. Thus, a sequential meshing of the respective sets of teeth provides a total 24° rotation, therefore fifteen such sequential meshings of the sets of teeth provides a complete, 360° rotation of the tube 80 and the coupling tube 82.

The sets of teeth 90/90*a* and 92/92*a* are sequentially meshed as shown in FIGS. 4A to 4D. As described above, in FIG. 4A, the piston 16 is in its first position, where the teeth 92/92*a* are fully meshed, and the teeth 90/90*a* are fully separated. Movement of the piston 16 to its second position (FIG. 4B) moves the teeth 92/92*a* apart and meshes the teeth 90/90*a*, providing a 6° rotation of the coupling tube 82, under the forcing action of the fluid flowing through the tool 10. The teeth are fully meshed when the tool 10 is in the further position of FIG. 4C, following which the piston 16 returns to the position of FIG. 4A, fully meshing the teeth 92/92*a* and separating the teeth 90/90*a*, to provide an 18 degree rotation of the coupling tube 82. Thus, it will be understood that fifteen such cycles of the tool 10 between the position of FIG. 4A and the position of FIG. 4C provides the 360° rotation of the coupling tube 82.

Furthermore, it is preferred that the greatest degree of rotation and thus the location of the teeth 92/92*a*, be provided during movement of the piston 16, and thus the coupling tube 82, towards the piston first position (FIG. 4A). This is because the large, rapidly applied WOB acts to mesh the teeth 92/92*a*, to provide the greater rotation. This is in contrast to the relatively slowly increasing fluid pressure moving the piston 16 downwardly. It will be understood that this rotation of the coupling tube 82 and thus the drill bit 8 relative to the hammer housing 12 is independent of rotation of the hammer 10 and bit 8 by the turbine 11.

Operation of the impact hammer 10 to achieve a percussive mechanical loading on the drill bit 8 is achieved in the fashion which will now be described. The drilling assembly 2 is made up to the string 15 at surface and run to drill the borehole 4.

The drill bit 8 is set down on the rack strata to be drilled and WOB is applied through the string 15. At the same time, fluid is pumped through the string 15 from surface, to activate the turbine 11 to rotate the drill bit 8 for drilling the formation 6. Drilling fluid exiting the turbine 11 flows into the bore 28 of the top sub 24 and is accelerated through the nozzle 30. This increases the velocity and reduces the pressure of the fluid, to assist in movement of the shuttle valve 14. The fluid then flows into the bore 38 of the shuttle valve 14, and subsequently exits through the port 44 into the area 52 in the housing 12. At this point, the seal face 18 of the shuttle valve 14 and the seal face 20 of the piston 16 are held in contact, by the applied WOB, the spring 64 and the fluid pressure. This provides a seal to prevent the passage of fluid between the valve 14 and the piston 16. As fluid fills the area 52, the fluid pressure increases as there is no route for escape of the fluid. This in turn applies pressure to the seal face 20 of the piston 16. A front ace 96 of the piston 16 is subjected to lower pressure through the ports 70 such that the front face of the piston is exposed to annulus pressure.

This pressure differential produces a force which causes the piston 16 to move rapidly forwards (downwardly in FIGS. 4A to 4D) relative to the housing 12. As the piston 16 moves relatively forward, the shuttle valve 14 is pushed forward with it, due to the increased pressure behind the valve 14, and this maintains the seal between the seal faces 18 and 20 of the two parts. In fact, the housing 12 moves up somewhat to accommodate this movement, as the drill bit is in contact with the rock strata being drilled. This motion continues until the shuttle 36 of the shuttle valve 14 contacts the stop shoulder 22 on the locating ring 42 (FIG. 4B). At this point, the fluid can start to flow between the seal faces 18 and 20 of the shuttle valve 14 and 16 respectively, and into the piston bore 60 (FIG. 4C), and the teeth 90/90*a* have fully meshed, providing a 6° rotation of the coupling tube 82, and thus of the drill bit.

As a consequence, the pressure in the housing 12 drops, and the shuttle valve 14 is returned to its original position by the spring 46. The fluid exhausts through the piston bore 60 and exits the hammer 10, flowing to the drill bit 8 and out through ports in the drill bit, in a fashion known in the art. The housing 12 then moves rapidly down to slam the piston 16, impacting the shuttle valve 14 against the piston, thus returning the piston to its original position (FIG. 4A). The teeth 92/92*a* have then fully meshed, providing an 18° rotation of the coupling tube 82 and the drill bit 8. The cycle then repeats to achieve a rapid percussive hammer effect.

Figure 6:
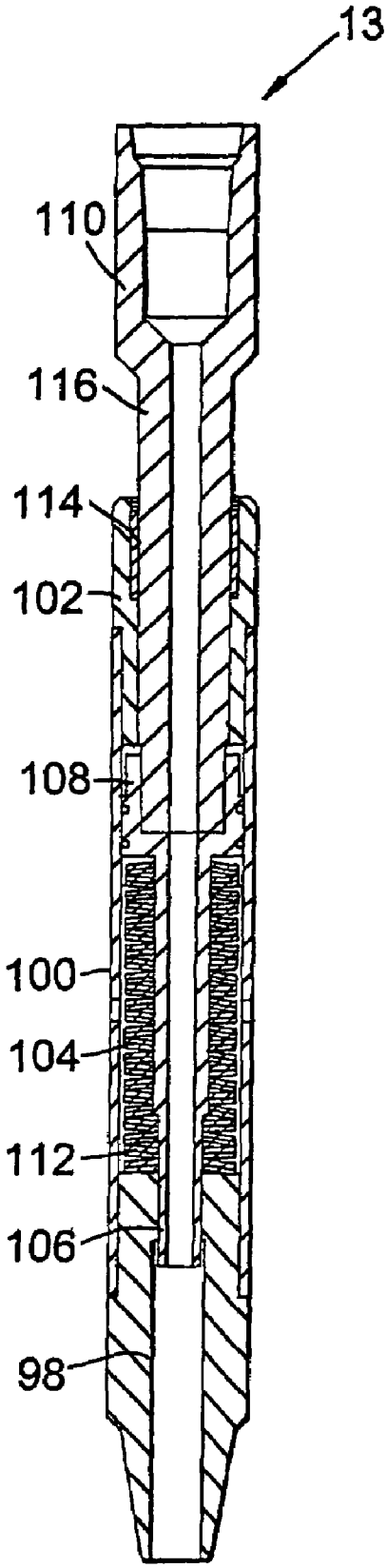
FIG. 6 is an enlarged, longitudinal cross-sectional view of a shock absorbing tool forming part of the downhole drilling assembly of FIGS. 1 and 2.

To reduce the vibration forces that are transmitted back up the drill string 15 during operation of the impact hammer 10, for example to limit transfer of shock to other bottom hole assembly components, such as electronic components in MWD equipment, the shock sub 13 is incorporated into the drilling assembly 2. FIG. 6 is an enlarged, detailed cross-sectional view of the shock sub 13. The shock sub 13 includes a bottom sub 98 coupled to an outer housing 100 and to the turbine 11, and an end nut 102 at the opposite end of the housing 100. A central shaft 104 is moveably mounted in the housing 100 and is received at a lower end 106 by the bottom sub 98 and at an upper end 108 by the outer housing 100. A bit box 110 is threaded to the central shaft 104 and couples the shock sub 13 and the drilling assembly 2 to the string 15. A number of disc springs 112 are mounted on the central shaft 104 and absorb shock loading transmitted to the shock sub 13 through the bottom sub 98. A bush 114 is mounted between the end nut 102 and a shaft 116 of the bit box 110, to restrict bending of the bit box 110 in use. In addition, the end nut 102 incorporates a spline (not shown) which engages a corresponding spline on the bit box sub shaft 116, to prevent rotation of the bit box sub 110 and thus to allow torque to be transmitted through the shock sub 13.

In use, shock loading generated by the hammer 10 is transmitted through the drilling assembly 2 to the shock sub 13, causing a movement of the bottom sub 98 and housing 100 relative to the bit box 110. This loading is partially absorbed by the disc springs 112 which are compressed between the upper end 108 of the central shaft 104 and the bottom sub 98, to reduce the loading transmitted up the drill spring 15.

The shock sub 13 thus both reduces vibration forces that are transmitted back up the drill string during operation of the hammer, protecting other bottom hole assembly (BHA) components; and creates a predictable hammer mass, that is, weight of the BHA components between the hammer and the shock sub 13.

As the hammer action is initiated by application of some hydraulic load to the bit, this ensures that the shuttle valve 14 and piston 16 have an initial seal (between seal faces 18 and 20) to start the impact cycle. The impact hammer will start impacting at a particular WOB depending on the geometry of the above-described components. Further, there is a range of average WOB over which the device will function. The characteristics of the impact hammer 10 may be tuned to particular applications by modification of the geometry of the fluid components and the spring rates. In particular, the following effects have been found by the inventors to hold:

increase of the spring rate of the piston spring 64 within a certain range of parameters decreases the range of WOB over which hammering occurs;

increase of the spring rate of the shuttle valve spring 46 will increase the WOB to initiate action and increase the range;

increase of the diameter of the shuttle bore 38 will increase the range of flow over which the hammer action occurs;

smoothing the flow path in the shuttle to reduce losses increases the WOB to initiate hammering, increases the range over which hammering occurs and reduces back pressure to drive the impact hammer 10;

increase of flow rate of fluid increases the impact frequency and impact force and produces a slight increase in WOB to initiate hammering;

the rate of impact can be modified by the flow rate and the rates of the springs and the weight, while increasing the pre-load of the piston spring 64 generally reduces WOB at which impact will be initiated;

decreasing the nozzle 30 diameter increases the WOB to initiate hammering but increases back pressure;

removal of the nozzle 30 may result in no hammer action being produced; and positioning the nozzle 30 further upstream of the shuttle valve 14 decreases the WOB to initiate hammering.

In addition, it is believed that a decrease in the piston seal face 20 area will decrease the impact force and the WOB to initiate impact.

Figure 7A:
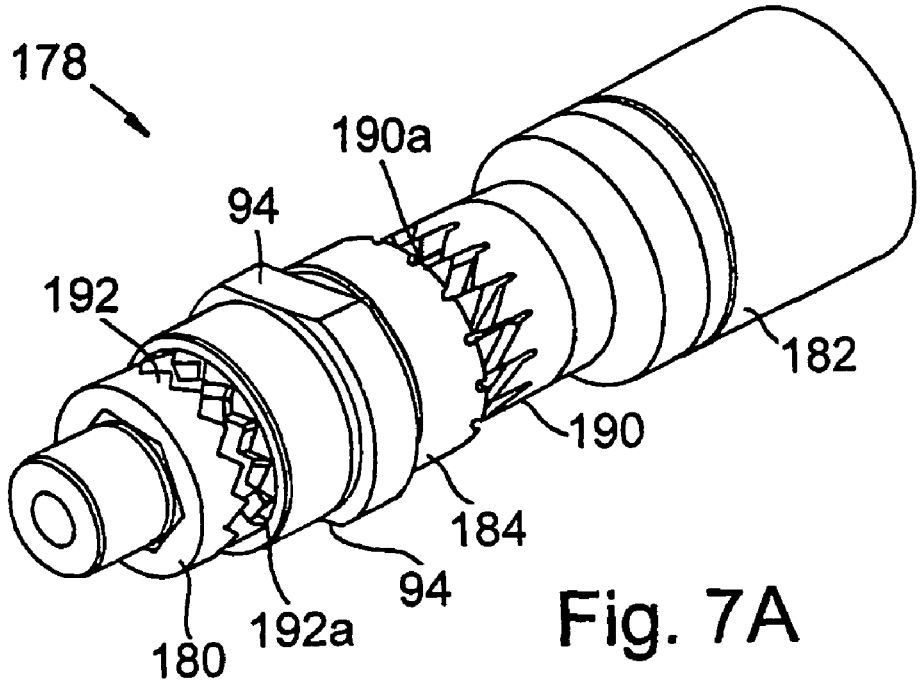
FIGS. 7A and 7B are perspective views of an alternative turning mechanism forming part of the tool of FIGS. 4A to 4D.
Figure 7B:
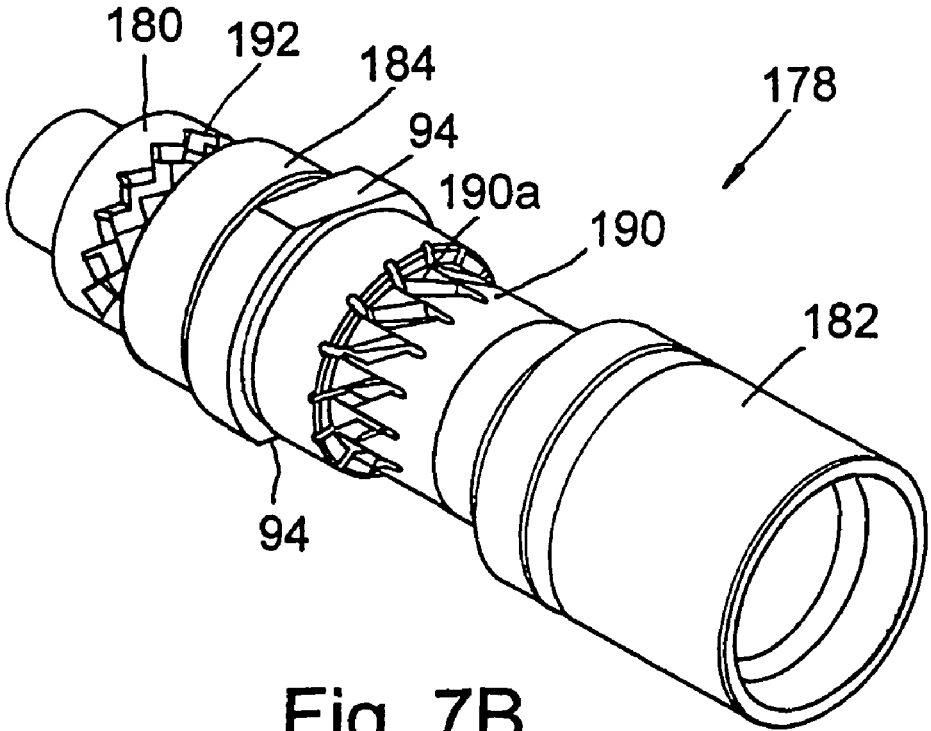

Turning now to FIGS. 7A and 7B, an alternative embodiment of a turning mechanism is shown and indicated by reference numeral 178. In this embodiment, teeth 190/190*a* are provided on the coupling tube 182, whilst teeth 192/192*a*, similar to the castellated teeth 92/92*a*, are provided on the tube 180. The teeth 192/192*a* provide an 18° rotation of the tube 180 and the coupling tube 182 on the downward stroke of the piston 16, that is, towards the position of FIG. 4C. Also, the sub 184 includes two flats 94, which allow the sub 184 to be engaged by a spanner and separated from the tool 10, if required.

Figure 8:
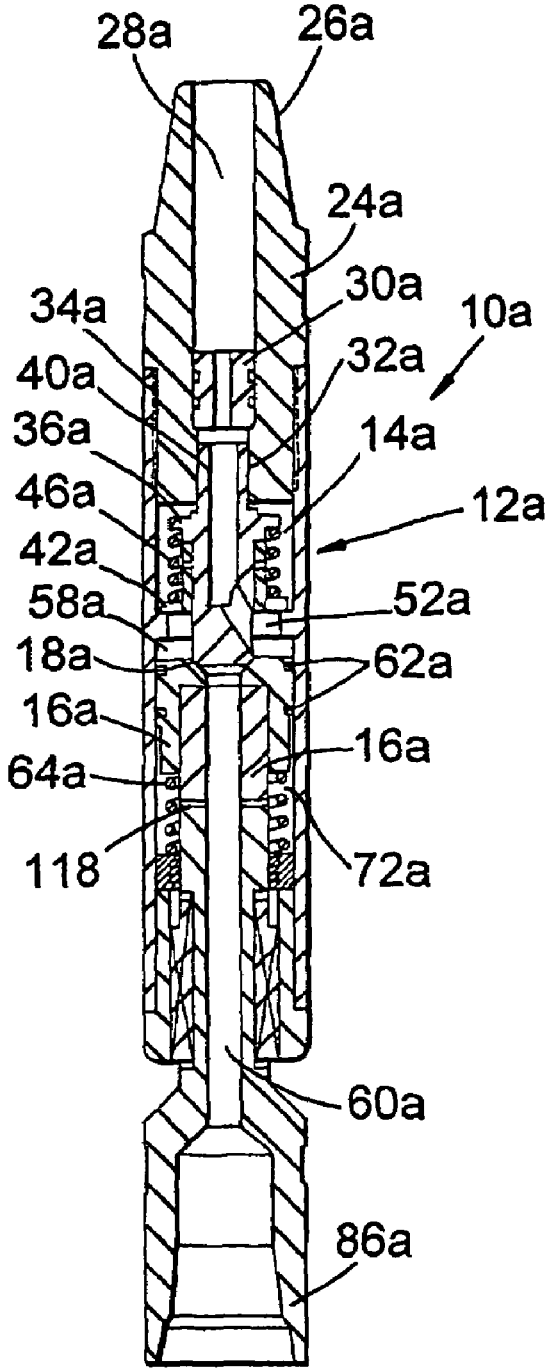
FIG. 8 is a longitudinal cross-sectional view of a downhole tool in accordance with an alternative embodiment of the present invention.

Referring now to FIG. 8, there is shown an impact hammer 10*a* in accordance with an alternative embodiment of the present invention. Like components of the hammer 10*a* with the hammer 10 of FIGS. 4A–4D share the same reference numerals with the addition of the suffix a.

The hammer 10*a* is essentially similar to the hammer 10 except that the hammer housing 12*a* does not include pressure equalisation ports 70. A drill bit or other downhole tool connected in the bit box 86 will give additional back pressure; some downhole tools such as the drill bit 8 may produce a pressure drop of 1000 psi across the tool. This additional pressure results in an increased pressure in the chamber 58*a* and, if ports 70 such as those in hammer 10 are provided in the housing, in an increased pressure difference between the chamber 52*a* and the annulus pressure in chamber 72*a*. The increased pressure differential results in the piston 16*a* being held forward and a greater spring force or weight on bit being required to push back the piston 16*a*. Instead of ports 70, the piston 16*a* includes a number of pressure equalisation ports 118 extending between the spring chamber 72*a* and the bore 60*a* of the piston. This reduces the differential pressure felt between the chamber 72*a* and the chamber 58*a* and isolates the piston seals 62*a* from annulus pressure. This allows the WOB required to activate the hammer action to be reduced.

In addition, the hammer 10*a* includes a nozzle 30*a* in the form of a sleeve located in the top sub through bore 28*a*, and the hammer 10*a* does not include a turning mechanism.

Figure 9:
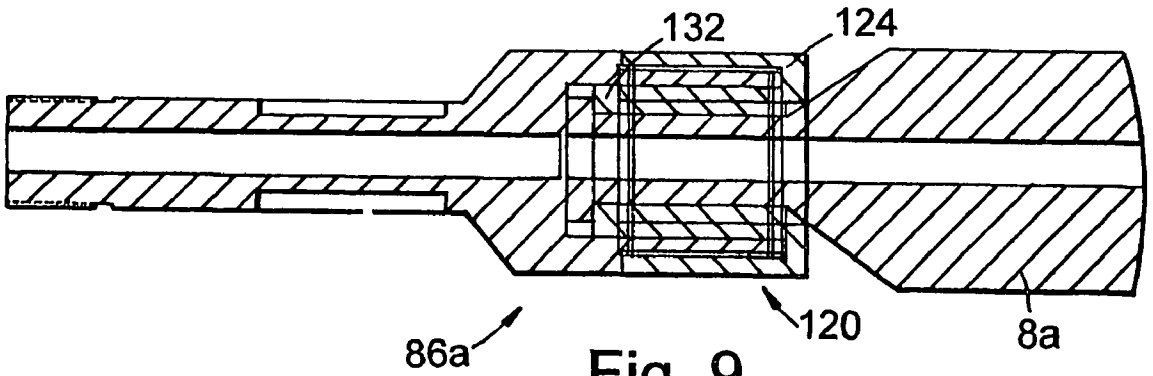
FIGS. 9 and 10 are longitudinal cross-sectional and bottom views, respectively of a drive transfer mechanism forming part of a downhole tool in accordance with a further alternative embodiment of the present invention.
Figure 10:
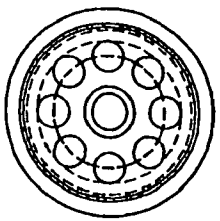

Turning now to FIGS. 9 and 10, there are shown longitudinal cross-sectional and end views, respectively, of an alternative bit-box 86*a*. The bit box 86*a* may be provided as part of the hammer 10 or 10*a* described above.

Figure 12:
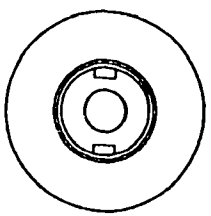
FIGS. 12 and 13 are top and bottom views of the bit box of FIG. 11.
Figure 11:
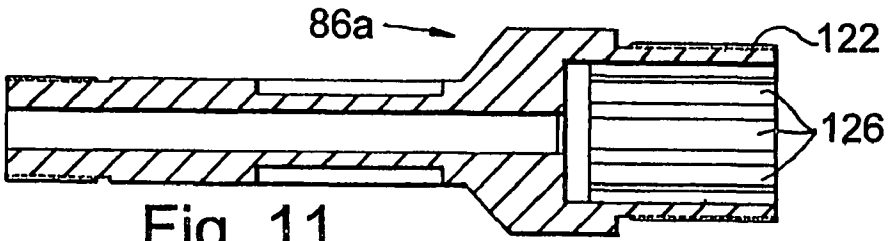
FIG. 11 is a view of a bit box forming part of the drive transfer mechanism of FIG. 9.
Figure 13:
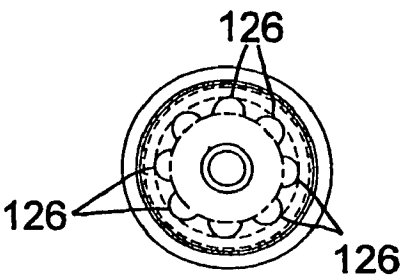
Figure 15:
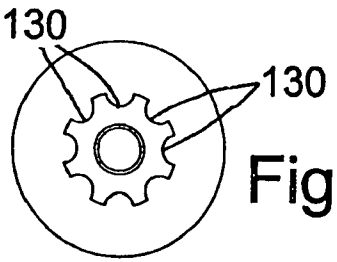
FIG. 15 is a top view of the drill bit of FIG. 14.
Figure 14:
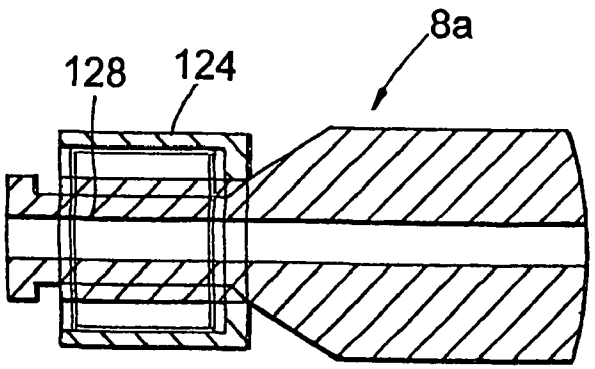
FIG. 14 is a view of a drill bit including part of the drive transfer mechanism of FIG. 9.

The bit box 86*a* is coupled to a drill bit 8*a* through a drive transfer mechanism coupling 120 which allows transferral of torque between the bit box 86*a* and the drill bit 8*a*, without affecting the integrity of the coupling 120. The bit box 86*a* is shown separately in the view of FIG. 11 and the top and bottom views of FIGS. 12 and 13, whilst the drill bit 8*a* is similarly shown separately in the view of FIG. 14 and the top view of FIG. 15.

The bit box 86*a* is externally threaded at 122 for receiving a locking nut 124 mounted on the drill bit 8*a*. The bit box 86*a* is internally profiled to define a number of axial keyways 126 which are semi-circular in cross section.

In a similar fashion, a shaft 128 of the drill bit 8*a* is externally profiled and defines a number of corresponding axial keyways 130. A number of keys in the form of rods 132 are located in the circular keyways defined when the keyways 126 of the bit box 86*a* and the keyways 130 of the drill bit 8*a* are aligned, as shown in FIGS. 9 and 10. These rods 132 lock the drill bit 8*a* against rotation relative to the bit box 86*a* such that the bit box 86*a* and drill bit 8*a* rotate together. The locking nut 124 is threaded onto the bit box 86*a* to lock the drill bit 8*a* to the bit box, but the nut 124 does not feel any additional torque during a drilling operation. This is in contrast to a conventional drill bit which would be torqued-up during a drilling operation using the hammer 10 or 10*a*.

Figure 16:
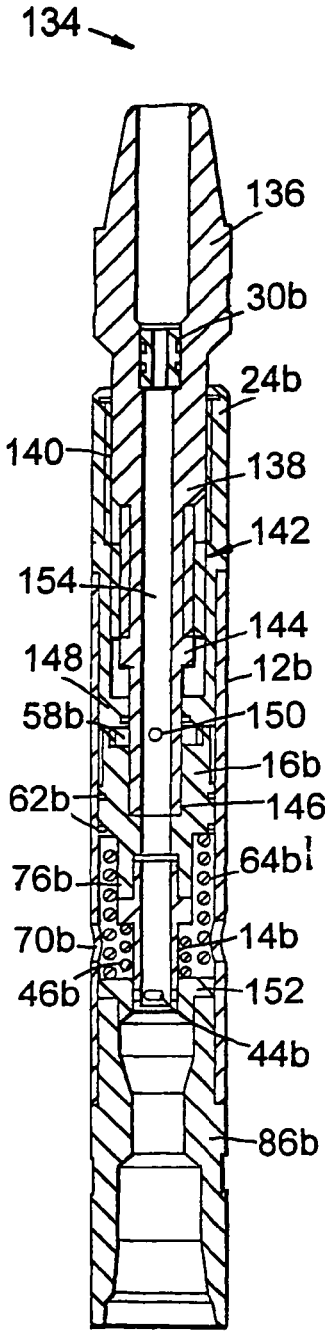
FIGS. 16 to 18 are longitudinal cross-sectional views of a downhole tool in accordance with a further alternative embodiment of the present invention, shown at various stages of a cycle in which the tool generates a mechanical load.

Turning now to FIG. 16, there is shown a longitudinal sectional view of a downhole tool in accordance with an alternative embodiment of the present invention, in the form of a hammer 134. The hammer 134 typically forms part of a fishing "string". It is often necessary during completion and production procedures carried out downhole to install tools, tool strings or other strings of tubing into a lined borehole. Occasionally, improper functioning of the tool or external conditions can cause the tool or tool string to become stuck in the borehole. It is then necessary to carry out a "fishing" procedure, where a dedicated tool is run into the borehole and is latched or hooked onto the stuck tool before exerting a large pull force through the fishing tool, to attempt to recover the stuck tool to surface. In extreme cases, if this fishing operation fails, it is necessary to remove the stuck tool by milling or drilling the tool out of the borehole, to re-open the bore.

The hammer 134 is designed to generate a cyclical, upwardly directed mechanical load, to assist in a fishing recovery procedure of such stuck tools.

The hammer 134 forms part of a fishing string run into a borehole on, for example, sections of connected tubing or coiled tubing, and is either directly latched or hooked onto the stuck tool, or a conventional fishing tool is provided for this purpose. The hammer 134 is similar to the hammers 10, 10*a* described above, except the hammer 134 allows a percussive, upwardly directed force to be exerted on the stuck object to assist in the fishing procedure.

The hammer 134 is similar in structure to the hammers 10, 10*a*, the primary difference between the tools being the method of operation, as will be described below. Like components of the hammer 134 with the hammer 10 of FIGS. 4A–4B share the same reference numerals, with the addition of the suffix b.

For brevity, only the major differences between the hammer 134 and the hammer 10 will be described in detail. The hammer 134 includes a tool joint 136 with a shaft 138 that extends through a top sub 24*b* of the tool, and which is moveable longitudinally within the tool housing 12*b*. The shaft 138 is supported by a bush 140 in the top sub and includes a splined coupling or keyway assembly 142 which restrains the tool joint 136 and shaft 138 against rotation relative to the tool housing 12*b*. The shaft 138 is coupled at a lower end to the piston 16*b* by a threaded connection 146. The piston 16*b* is itself movable between first and further, second positions and is shown in FIG. 16 held in a first position in abutment with a lower end 148 of the top sub 24*b* by a spring 64*b*. A chamber 58*b* is defined between the piston 16*b* and the lower end 148 of top sub 24*b*, and a number of flow ports 150 extend through the wall of the shaft 138. A lower end 76*b* of the piston 16*b* slidably receives the shuttle valve 14*b*, which is held in a first position by valve spring 46*b*. A number of flow ports 44*b* are provided in a lower end of the shuttle valve 14*b* and in the respective first positions of the valve 14*b* and the piston 16*b*, the flow ports 44*b* are closed by a valve porting piece in the form of a collar 152, which is connected to the bit box 86*b*.

The hammer 134 is thus shown in FIG. 16 in the running position with the valve 14*b* and piston 16*b* in their first positions and the flow ports 44*b* closed, to prevent fluid flow through the tool.

When the hammer has been directly or indirectly latched to the object to be recovered, pressurised drive fluid is pumped down through the tool, passing through nozzle 30*b* and through the tool joint bore 154. This fluid fills the chamber 58*b* through flow ports 150, urging the piston 16*b* downwardly to the second position shown in FIG. 17. The pressurised fluid also acts on the shuttle valve 14*b*, and the fluid acts together with the piston 16*b* to move the shuttle valve 14*b* to the further, second position of FIG. 17, opening the flow ports 44*b* and allowing fluid flow through the tool.

Figure 17:
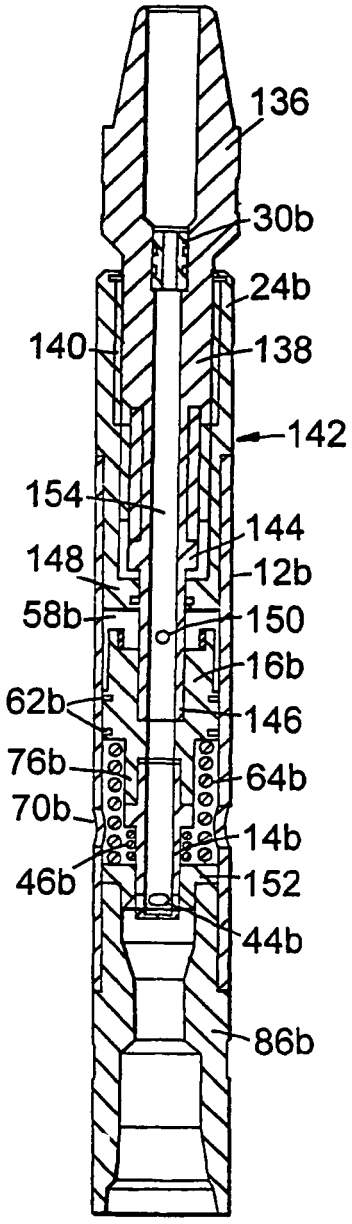
Figure 18:
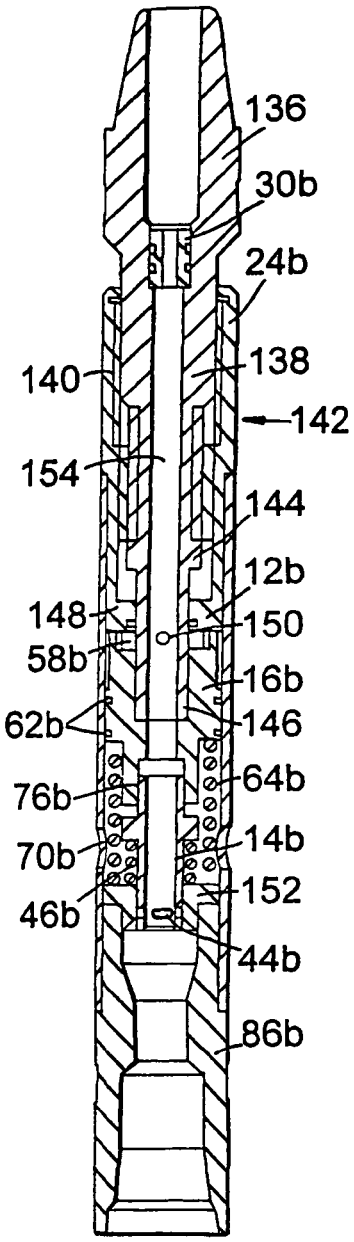

The tool is then pulled to exert a pulling force on the object to be recovered. As the tool is pulled, the tool joint 136, shaft 138 and piston 16*b* move upwards and the shuttle valve spring 46*b* moves the shuttle valve 14*b* upwardly. The tool is thus returned to the extended configuration of FIG. 16, with the shuttle valve 14*b* and piston 16*b* in their first positions. At this point, the shuttle valve flow ports 44*b* are aligned with the collar 152, thus blocking the flow of fluid through the tool. As the pressure of the drive fluid rises, the piston 16*b* and shuttle valve 14*b* are forced downwardly to their second positions of FIG. 17. This opens the flow ports 44*b* again and drive fluid is allowed to discharge through the tool, causing a fall in the pressure before the piston 16*b*. The piston spring 64*b* in combination with the pull force from surface rapidly returns the piston 16*b* and thus the tool joint 136 and shaft 138 to the first position, as shown in FIG. 18. This creates an impact which is transmitted to the lower end 148 of the top sub 24*b*. The upward impact force generated is thus relatively large, as the fluid pressure required to compress the tool to the configuration of FIG. 17 is relatively high. This upward impact force is thus transmitted to the object to be recovered.

As the piston 16*b* moves upwardly, fluid in the chamber 58*b* is discharged through the flow ports 150 into the bore 154. The shuttle valve spring 46*b* is rated to return the shuttle valve 14*b* upwardly after the piston 16*b* has returned to the first position, and this maintains the flow ports 44*b* open for a short time, allowing discharge of fluid from the chamber 58*b* and out of the tool. When this fluid has discharged and the pressure has dropped sufficiently, the shuttle valve spring 46*b* returns the shuttle valve 14*b* to the first position of FIG. 16. The procedure then repeats and a rapid, percussive, upwardly directed force is exerted on the stuck object in addition to the pull from surface. This assists in dislodging the object from the borehole.

The nozzle 13*b* acts to stop immediate replacement of fluid escaping from the chamber 58*b*, and thus slows down the incoming drive fluid sufficiently to allow the piston spring 64*b* to return the piston 16*b* to the first position of FIG. 16. The mass of the shuttle valve 14*b* and the spring rate of the shuttle spring 46*b* are chosen to ensure that the piston 16*b* returns to its first position before the shuttle valve 14*b*, as discussed above. This is to ensure that the fluid which is discharging from chamber 58*b* has time to escape before the shuttle valve 14*b* moves upwardly to the first position, closing the flow ports 44*b*. The frequency of the process is determined by the mass of the shuttle valve 14*b* and spring tension of the shuttle spring 46*b*. Pressure equalisation ports 70*b* ensure that fluid is not trapped in the area behind the piston 16*b*, which would cause hydraulic lock-up of the piston, preventing it from moving between the first and second positions.

Operation of the hammer may be enhanced by locating a non-return valve such as a ball valve below the nozzle 30*b*, which is closed to stop the flow of fluid through the nozzle as the piston 16*b* is returned from the second position of FIG. 17 to the first position of FIG. 16. This increases the speed with which the piston 16*b* returns to the first position and therefore the speed with which the tool decompresses to the position of FIG. 16.

In further alternative embodiments of the present invention, the impact hammers 10, 10*a*, 134 may be used for expanding tubing. For example, expandable liner, sand-screens and other tubulars have been developed for use in the downhole environment. These tubulars are typically run-into a borehole in an unexpanded configuration, and are then located downhole before being diametrically expanded to a desired outer diameter. This is conventionally achieved by forcing a swage cone down through the unexpanded tubing in a top-down expansion procedure. This procedure may be greatly enhanced using the impact hammer 10, 10*a* as part of a tool string or assembly for forcing the swage cone down through the tubing, by exerting a percussive impact loading on the cone. Alternatively, the hammer tool 134 may be employed for pulling a swage cone upwardly through the unexpanded tubing in a bottom-up expansion procedure.

Various modifications may be made to the foregoing within the scope of the present invention.

For example, the nozzle 30 may be provided as a separate component, such as a tubular insert for location in the bore 28. The piston 16 may include an integral coupling.

The tool may be provided without a turning mechanism, to provide a straight, non rotary impact. In this event, the tool may include a key mechanism, for preventing rotation of the piston 16. There may be a plurality of ports 44 in the shuttle valve 14, and the ports may be radially or otherwise directed.

The rotary drill string may be driven by a top drive or kelly at surface, or any suitable downhole motor such as a positive displacement motor may be employed.

The bit box 86*a* may include any desired shape of keyways, and may for example include a keyway in the bit box for mating with a key on the drill bit, or vice versa. Alternatively, the bit box may include a splined coupling.

The hammers 10*a*, 134 may include a turning mechanism as shown in FIGS. 5A/5B or 7A/7B.

The shock sub may be provided anywhere in the drilling assembly, or alternatively in the string above the drilling assembly, and may be used to control the amount of force produced at the drill bit. The degree of isolation of the drill string from the hammer produced by the shock sub depends on the exact configuration and thus the damping effect of the shock sub. A fishing string including the hammer 134 may include a shock sub. The shock sub may equally be coupled to a drilling assembly the opposite way around from that shown in FIG. 2. In other words, the bit box 110 may be at a lower end of the shock sub in a "box-down" position. The shock sub 13 functions equally well in this position.

The downhole tool 134 of FIGS. 16–18 may alternatively comprise a dedicated fishing tool or retrieval tool.

What is claimed is:

1. A downhole tool for generating a mechanical load, the tool comprising:

first and second members each moveable between at least a respective first and a respective further position in response to an applied fluid pressure;

a sealing assembly for preventing fluid flow through the tool, the sealing assembly being released when the first and second members are moved to their respective further positions, so as to allow fluid flow through the tool; and a generally hollow housing defining an internal bore in which the first and second members are disposed for longitudinal movement therein, the housing defining a flow restriction comprising a nozzle;

whereby, in use, when the sealing assembly is released the second member impacts a remainder of the tool to generate a mechanical load.

2. A tool as claimed in claim 1, wherein the flow restriction is disposed adjacent an end of the first member.

3. A tool as claimed in claim 1, wherein a part of the bore defining the flow restriction is adapted to slidably receive at least part of the first member.

4. A tool as claimed in claim 1, wherein the nozzle comprises a separate component adapted to be located in the tool.

5. A tool as claimed in claim 1, wherein the flow restriction is selected to determine a rate of generation of the mechanical tool.

6. A tool as claimed in claim 1, wherein the downhole tool comprises a downhole hammer for generating a mechanical impact load.

7. A method of drilling a borehole comprising the steps of:

coupling a drill bit to a downhole hammer as claimed in claim 6;

rotating the drill bit;

exerting a first force on the drill bit to cause the drill bit to drill a borehole; and activating the downhole hammer to exert a second, cyclical hammer force on the drill bit.

8. A method as claimed in claim 7, further comprising activating the hammer by applying a primary mechanical force on the hammer and supplying fluid to the hammer.

9. A method as claimed in claim 8, further comprising urging a shuffle valve and a piston of the hammer from first to second positions under applied fluid pressure whilst sealing between the valve and the piston to prevent fluid flow therebetween.

10. A method as claimed in claim 9, further comprising restraining the shuttle valve against movement beyond the second position, and applying further fluid pressure to move the piston to a further position releasing the seal between the shuttle valve and the piston allowing fluid flow therebetween, to return the piston to the first position to impact a remainder of the hammer and exert the cyclical hammer force on the drill bit.

11. A method as claimed in claim 9, further comprising biasing the shuttle valve towards the first position before the piston returns to the first position.

12. A method as claimed in claim 11, further comprising impacting the piston against the shuttle valve to generating the hammer force.

13. A method of retrieving an object from a borehole comprising the steps of:

coupling a downhole hammer as claimed in claim 6 to the object;

exerting a first force on the downhole hammer and thus on the object; and activating the downhole hammer to exert an additional, cyclical second force on the object.

14. A method as claimed in claim 13, further comprising activating the impact hammer by applying a primary mechanical pull force on the tool and supplying fluid to the tool.

15. A method as claimed in claim 14, further comprising urging a shuttle valve and a piston of the hammer from first to second positions under applied fluid pressure whilst sealing between the valve and the piston to prevent fluid flow therebetween.

16. A method as claimed in claim 15, further comprising opening fluid flow through the shuttle valve when the shuttle valve is in the second position, to allow fluid flow through the hammer, to return the piston to the first position to impact a remainder of the tool and exert the cyclical retrieval force on the object.

17. A method as claimed in claim 15, further comprising biasing the piston towards the first position before the shuttle valve returns to the first position.

18. A method as claimed in claim 17, further comprising impacting the piston against part of the hammer to generate the retrieval force.

19. A tool as claimed in claim 1, wherein the first and second members are movable between first and second positions, respectively, the sealing assembly being adapted to seal between the first and second members during such movement to prevent fluid flow between the first and second members, and wherein the second member is movable to a further position where fluid flow is permitted between the first and second members and through the tool.

20. A tool as claimed in claim 19, wherein the sealing assembly is releasable on further application of fluid pressure, to allow the second member to return to the first position whereby the second member is impacted by a remainder of the hammer.

21. A tool as claimed in claim 1, wherein the first member is adapted to return to the first position before the first member is impacted by the second member.

22. A tool as claimed in claim 1, wherein the sealing assembly comprises respective seal faces of the first and second members.

23. A tool as claimed in claim 1, wherein the first and second members are biased towards their respective first positions.

24. A tool as claimed in claim 1, wherein an end of the first member defines a seal face for sealing abutment with the second member.

25. A tool as claimed in claim 1, wherein at least one flow port is defined in a wall of the first member to selectively allow fluid flow through the first member.

26. A tool as claimed in claim 25, wherein the tool further comprises a housing defining a chamber in fluid communication with the first member through the flow port, for receiving fluid from the first member.

27. A tool as claimed in claim 26, wherein the chamber is in selective fluid communication with the second member, to allow fluid flow between the first member and the second member through the chamber.

28. A tool as claimed in claim 1, further comprising a restraint for restraining movement of the first member relative to the second member to cause the sealing assembly to release, to allow fluid flow between the first and second members.

29. A tool as claimed in claim 28, wherein the restraint comprises a shoulder in the housing adapted to abut and restrain the first member.

30. A tool as claimed in claim 29, wherein the shoulder comprises a substantially radially inwardly extending shoulder adapted to abut a co-operating outwardly extending shoulder on the first member.

31. A tool as claimed in claim 1, wherein the downhole tool comprises a downhole hammer or retrieval tool for generating a mechanical impact load for retrieving an object from a borehole.

32. A tool as claimed in claim 1, wherein when the first and second members are in their further positions, fluid flow allows the second member to return to the first position to impact a remainder of the tool and generate the mechanical load.

33. A tool as claimed in claim 1, wherein the sealing assembly is adapted to seal the tool when the first and second members are in their respective first positions and to allow fluid flow through the tool when the first and second members are in their respective further positions.

34. A tool as claimed in claim 1, wherein the sealing assembly comprises a seal member adapted to prevent fluid flow through the tool when the first and second members are in their respective first positions.

35. A tool as claimed in claim 34, wherein the sealing member is adapted to abut the first member to prevent fluid flow through the tool.

36. A tool as claimed in claim 34, wherein the seal member comprises a valve member adapted to receive and abut the first member to prevent fluid flow through the tool.

37. A tool as claimed in claim 1, wherein the first member includes at least one flow port for fluid flow through the first member when the first member is in the further position.

38. A method of expanding an expandable downhole tubular, the method comprising the steps of:

locating an expansion member in unexpanded downhole tubing to be expanded;

coupling a downhole tool for generating a cyclical mechanical load as claimed in claim 1 to the expansion member; and activating the downhole tool to exert a cyclical mechanical load on the expansion member, to translate the expansion member through the tubing to diametrically expand the tubing.

39. A tool as claimed in claim 1, wherein the first and second members are biased towards their respective first positions.

40. A tool as claimed in claim 1, further comprising a housing defining a chamber in which the second member is mounted, the chamber adapted to receive fluid to move the second member towards the further position.

41. A tool as claimed in claim 1, wherein the downhole tool is activatable in response to a combination of a primary mechanical load applied to the tool and fluid pressure.

42. A tool as claimed in claim 1, further comprising a turning mechanism for rotating at least a part of the tool relative to the remainder of the tool.

43. A tool as claimed in claim 42, wherein the turning mechanism comprises a first mechanism part coupled to the second member of the tool, a second mechanism part for coupling to an object or member to be rotated, and an intermediate mechanism part, coupled to a housing of the tool for rotating one or both of the first and second mechanism parts.

44. A tool as claimed in claim 1, wherein the housing includes at least one port to open part of the housing to external fluid pressure.

45. A tool as claimed in claim 1, wherein the second member includes at least one pressure equalization port for equalizing pressure between the outside and the inside of the second member.

46. A tool as claimed in claim 1, wherein the first member comprises a tubular shuttle valve defining an internal bore.

47. A tool as claimed in claim 46, wherein an end of the shuttle valve defines a seal face for sealing abutment with the second member.

48. A tool as claimed in claim 1, wherein at least one flow port is defined through a wall of the first member to selectively allow fluid flow through the first member.

49. A tool as claimed in claim 1, wherein the second member comprises a tubular piston defining an internal bore.

50. A tool as claimed in claim 1, further comprising a drive transfer coupling for transferring a rotational force through the tool.

51. A tool as claimed in claim 50, wherein the drive transfer coupling includes a key assembly having a channel formed in the coupling and adapted to receive a key to restrain a secondary member coupled to the tool against rotation with respect to the coupling.

52. A tool as claimed in claim 51, wherein the drive transfer coupling includes a plurality of keyways adapted to align with a corresponding plurality of keyways in the secondary member and to receive a respective key in each pair of aligned keyways.

53. A downhole hammer assembly for hammering a downhole assembly comprising a downhole tool as claimed in claim 1.

54. A rotary drill string assembly including a downhole tool as claimed in claim 1.

55. A downhole fishing assembly for retrieving an object from a borehole, comprising a downhole tool as claimed in claim 1.

56. A downhole tool for generating a mechanical load, the tool comprising:

first and second members each moveable between at least a respective first and a respective further position in response to an applied fluid pressure;

a sealing assembly for preventing fluid flow through the tool, the sealing assembly being released when the first and second members are moved to their respective further positions, so as to allow fluid flow through the tool;

a generally hollow housing defining an internal bore in which the first and second members are disposed for longitudinal movement therein, the housing defining a flow restriction; and a key assembly for restraining the second member against rotation with respect to a housing of the tool, whereby, in use, when the sealing assembly is released the second member impacts a remainder of the tool to generate a mechanical load.

57. A downhole tool for generating a mechanical load, the tool comprising:

a generally hollow housing defining an internal bore and a flow restriction comprising a nozzle;

first and second members each disposed at least partly in the housing for longitudinal movement with respect to the housing between respective first and second positions in response to an applied fluid pressure;

sealing means for sealing between the first and second members during movement of the members from the respective first to the respective second positions; and restraint means for restraining movement of the first member relative to the second member so as to cause the sealing means to release, to allow fluid flow between the first and second members;

whereby fluid flow between the first and second members allows the second member to return to the first position, to impact the first member and generate the mechanical load.

58. A downhole tool for generating a mechanical load, the tool comprising:

a generally hollow housing defining an internal bore and a flow restriction comprising a nozzle;

first and second members each disposed at least partly in the housing for longitudinal movement with respect to the housing between respective first and second positions in response to an applied fluid pressure; and a sealing assembly adapted to seal the tool to prevent fluid flow through the tool when the first and second members are in their respective first positions and to allow fluid flow through the tool when the first and second members are in their respective second positions;

whereby fluid flow through the tool allows the second member to return to the first position to impact a remainder of the tool and generate the mechanical load.

59. A drilling assembly comprising a drilling motor and a downhole tool for generating a mechanical load, the tool comprising:

first and second members each moveable between at least a respective first and a respective further position in response to an applied fluid pressure;

a sealing assembly for preventing fluid flow through the tool, the sealing assembly being released when the first and second members are moved to their respective further positions, so as to allow fluid flow through the tool; and a generally hollow housing defining an internal bore in which the first and second members are disposed for longitudinal movement therein, the housing defining a flow restriction;

whereby, in use, when the sealing assembly is released the second member impacts a remainder of the tool to generate a mechanical load.

60. An assembly as claimed in claim 59, further comprising a shock absorbing tool.

61. An assembly as claimed in claim 60, wherein the shock absorbing tool comprises a body; a shaft moveably mounted to the body; and a biasing assembly coupled between the shaft and the body.

62. A downhole hammer comprising:

a first member; a second member; a generally hollow housing defining an internal bore in which the first and second members are disposed for longitudinal movement therein and a flow restriction comprising a nozzle; and sealing means between said first and second members, wherein, in use, application of fluid pressure to the hammer causes the first and second members to move from respective first to respective second positions and during such movement the sealing means sealing between the first and second members substantially prevents fluid flow therebetween; and wherein further, in use, further application of fluid pressure causes the sealing means to release, to allow the second member to return to the first position whereby the second member is impacted by a remainder of the hammer.

* * * * *